US007013814B2

(12) United States Patent
Modesitt et al.

(10) Patent No.: US 7,013,814 B2
(45) Date of Patent: Mar. 21, 2006

(54) SLIP SHEET

(75) Inventors: Ronald F. Modesitt, Lakewood, CO (US); David W. Moss, Wheat Ridge, CO (US); Deborah Mulnix, Littleton, CO (US); Harley D. McKinney, Jr., Arvada, CO (US)

(73) Assignee: Coors Illinois Tool Works Inc., Glenview, IL (US)

( * ) Notice: Subject to any disclaimer, the term of this patent is extended or adjusted under 35 U.S.C. 154(b) by 226 days.

(21) Appl. No.: 09/797,136

(22) Filed: Feb. 28, 2001

(65) Prior Publication Data

US 2002/0002937 A1 Jan. 10, 2002

Related U.S. Application Data

(60) Provisional application No. 60/186,411, filed on Mar. 2, 2000.

(51) Int. Cl.
*B65D 19/00* (2006.01)

(52) U.S. Cl. ..... 108/51.3

(58) Field of Classification Search ..... 108/51.3, 108/51.11, 53.1

See application file for complete search history.

(56) References Cited

U.S. PATENT DOCUMENTS 3,199,468 A 8/1965 Sullivan
3,545,249 A 12/1970 Brown
3,709,161 A * 1/1973 Kauffman
3,776,145 A 12/1973 Anderson et al.
3,850,116 A 11/1974 Mackes
3,982,057 A * 9/1976 Briggs et al.
4,042,127 A 8/1977 Brossia
4,507,348 A 3/1985 Nagata et al.
4,562,718 A 1/1986 Dunk
4,906,510 A 3/1990 Todor, Jr. et al.
5,111,754 A * 5/1992 Adams, Jr.
5,226,372 A 7/1993 Frenkel et al.
5,269,219 A * 12/1993 Juvik-Woods
5,493,962 A * 2/1996 McCarthy
5,551,353 A * 9/1996 Fiedler
6,095,061 A * 8/2000 Perazzo
6,155,181 A * 12/2000 Chilcutt ..... 108/51.3
6,227,515 B1 * 5/2001 Broyles

FOREIGN PATENT DOCUMENTS

DE 2625346 6/1976
DE 19636554 A1 * 3/1998

* cited by examiner

*Primary Examiner*—Jose V. Chen
(74) *Attorney, Agent, or Firm*—Leydig, Voit & Mayer, Ltd.

(57) ABSTRACT

A slip sheet pallet comprising a first sheet engageable with a stacked array which is to be supported; a second sheet attached to the first sheet; at least one flap connected to and extending outwardly from at least one of the first and second sheets and gripable by a lift truck gripping assembly; at least one of the first and second sheets comprising a compound sheet with a plurality of distinct connected layers.

20 Claims, 5 Drawing Sheets

SLIP SHEET

RECREANCE TO COP ENDING PROVISIONAL APPLICATION

The benefit of earlier filed U.S. Provisional Patent Application Ser. No. 60/186,411 filed Mar. 2, 2000, now abandoned, for SLIP SHEET, which is hereby incorporated by reference for all that it discloses, is hereby claimed.

BACKGROUND OF THE INVENTION

This invention relates to pallets and slip sheets, and more particularly to an improved slip sheet.

Material handling apparatus for industrial use is commonly designed for ease of storage and handling in a warehouse and shipping on truck or rail. Different kinds of containers for various types of goods, for example cases of beer, are commonly arranged in a generally cubical array and are supported on a pallet. The array and pallet may then be lifted by a lift truck and stacked upon another array of containers for conservation of storage space. The array and pallet may also be conveniently loaded and unloaded for shipping in trucks, railcars, ships and other transport means.

Commonly used pallets are constructed from wood with two planar support surfaces separated by spaced rails. The support surfaces have the general size and shape of the array to be supported, and the pallet is about 5 ½inches thick. The pallet and array of containers are lifted and moved by inserting the forks of a forklift between the vertically separated support surfaces and the horizontally spaced spacer rails. Wood pallets are relatively expensive. Furthermore, the thickness of these pallets takes up useful storage space and their weight adds to transportation expense.

These problems have been somewhat overcome by the development of slip sheets, also referred to as slip sheet pallets or slip pallets. A typical slip sheet comprises a relatively thin sheet of a material, such as chipboard or plastic, for supporting the array of containers. The array and slip sheet are lifted by gripping a lip portion extending from an edge of the slip sheet and holding it under tension with a lift truck gripping mechanism while slipping a platen (a spatula like member) of the lift truck under the slip sheet. The platen is raised to lift the array and slip sheet and the lift truck then moves them to a desired location where the slip sheet and the array are pushed off of the platen. Although slip sheets offer various advantages over common wooden pallets, some problems have been found in their use. Unlike conventional wood pallets, slip sheets do not have a lower opening for insertion of a lift truck lifting platform. Sliding a platen under a slip sheet resting on a hard surface causes a deformation wave to pass through the slip sheet as the leading edge of the platen moves below it. One significant problem with simple slip sheets formed from a single layer of plastic or chip board has been that shock, vibration and deformation waves, encountered during lift truck handling or rail or truck transportation are transmitted through the slip sheet to the array causing damage to items in the array, particularly items stacked at the bottom of the array. For example bottom tier beverage cans are often damaged by such shocks or deformations. Attempts to provide slip sheets having cushioning and stiffening capabilities to resist such shocks and deformation waves have heretofore met with only limited success. In some cases the shock absorption capabilities have been too meager. In others the cost of producing such shock absorbing slip sheets has been too great and/or the size and/or weight of the shock absorbing slip sheet has been commercially unacceptable. Also, where shock absorption is achieved by making the slip sheet extremely flexible, damage caused by deformation waves has been exacerbated.

Some of the various types of pallets and slip sheets which have been employed in the past are disclosed in: U.S. Pat. No. 3,199,468 issued Aug. 10, 1965 for NESTABLE PALLETS of Sullivan; U.S. Pat. No. 3,545,249 issued Dec. 8, 1970 for DIMPLE AND METHOD OF FORMING SAME of Brown; U.S. Pat. No. 3,776,145 issued Dec. 4, 1973 for SLIP PALLET of Anderson, et al; U.S. Pat. No. 3,850,116 issued Nov. 26, 1974 for SLIP PALLET REINFORCED WITH FILLERS of Mackes; U.S. Pat. No. 4,042,127 issued Aug. 16, 1977 for SLIP PALLET AND DIVIDER SHEET of Brossia; U.S. Pat. No. 4,507,348 issued Mar. 26, 1985 for CORRUGATED BOARD-LIKE SHEET MADE OF SYNTHETIC RESIN of Nagata, et al; U.S. Pat. No. 4,562,718 issued Jan. 7, 1986 for PALLET AND METHOD OF PRODUCTION of Dunk; U.S. Pat. No. 4,906,510 issued Mar. 6, 1990 for METHOD AND APPARATUS FOR FORMING A HINGE FOR LAMINATED CORRUGATED MATERIAL of Todor, Jr., et al.; U.S. Pat. No. 5,226,372 issued Jul. 13, 1993 for SLIP PALLET WITH A CUSHIONING EFFECT of Frenkel, et al.; and German Patent No. 2625346 filed Jun. 4, 1976 for FLEXIBLE COMPONENT of Stangeland, et al. The above patents are each hereby specifically incorporated by reference for all that is disclosed therein.

SUMMARY OF THE INVENTION

The present invention is directed to a slip sheet having substantial shock absorbing and deformation resisting capabilities and which is relatively durable, compact, light weight and inexpensive. The slip sheet is particularly adapted for use with stacked arrays of beverage containers. In one preferred embodiment, the slip sheet comprises plural sheets at least one of which is a composite sheet which may be a honeycomb sheet or fluted sheet or standing rib sheet constructed from paper or plastic which provides shock absorption and deformation reduction.

BRIEF DESCRIPTION THE DRAWING

DETAILED DESCRIPTION OF THE INVENTION

Figure 1:
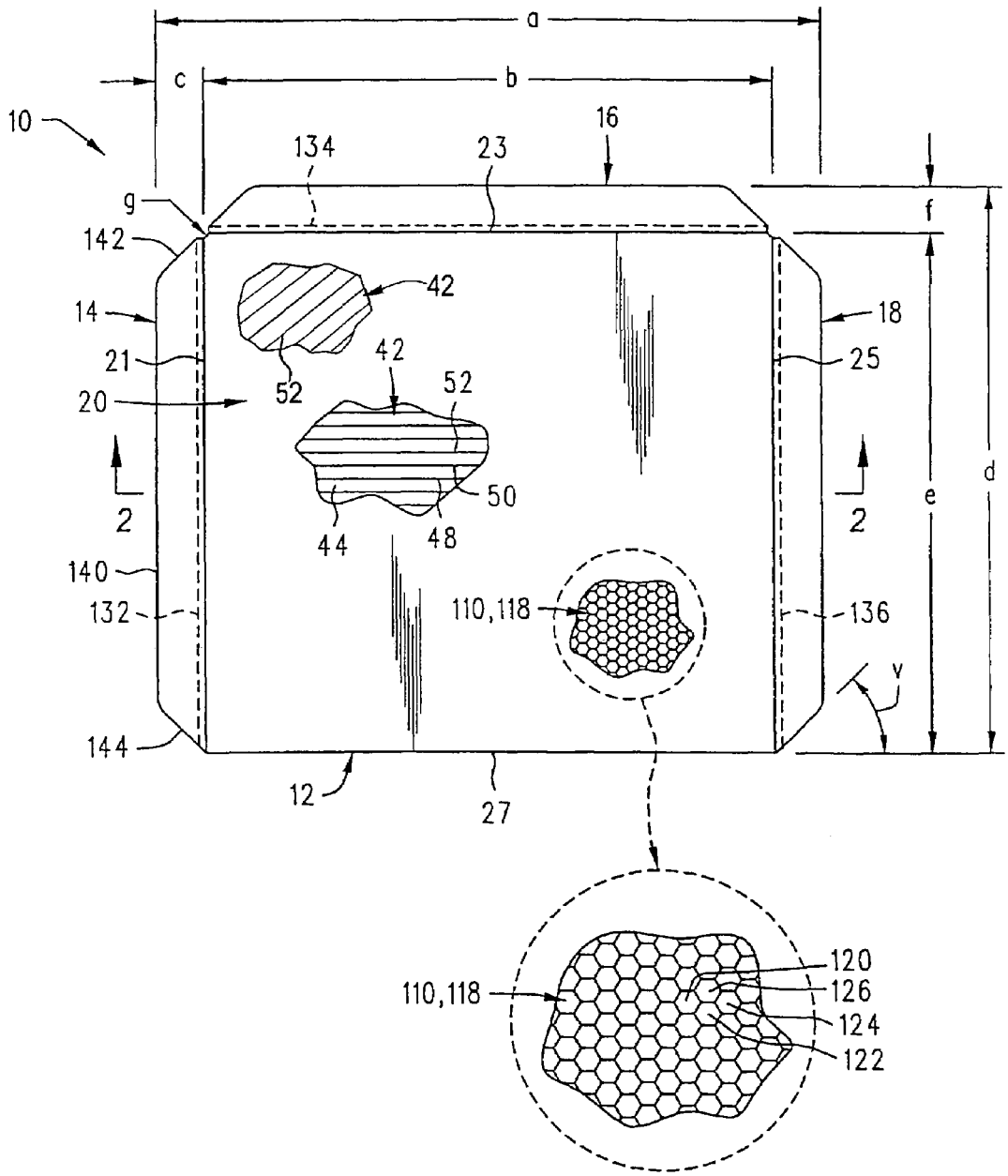
FIG. 1 is a top plan view of a slip sheet pallet.
Figure 2:
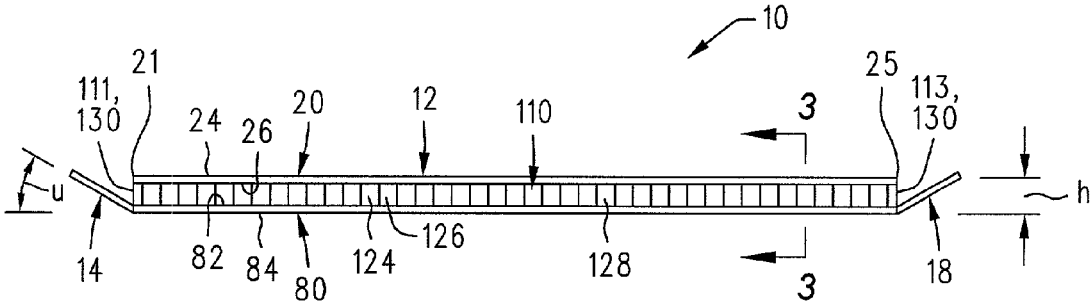
FIG. 2 is a cross sectional elevation view of a slip sheet pallet.

FIGS. 1 and 2 illustrate a slip sheet or slip pallet or ship sheet pallet 10 having a generally parallelepiped shaped body 12 (i.e., a rectangular box shaped body). At least one, and preferably a plurality of peripheral flaps 14, 16, 18 extend outwardly from the body 12. The body 12 includes a top sheet 20, a base sheet 80, and an intermediate sheet 110.

Figure 3:
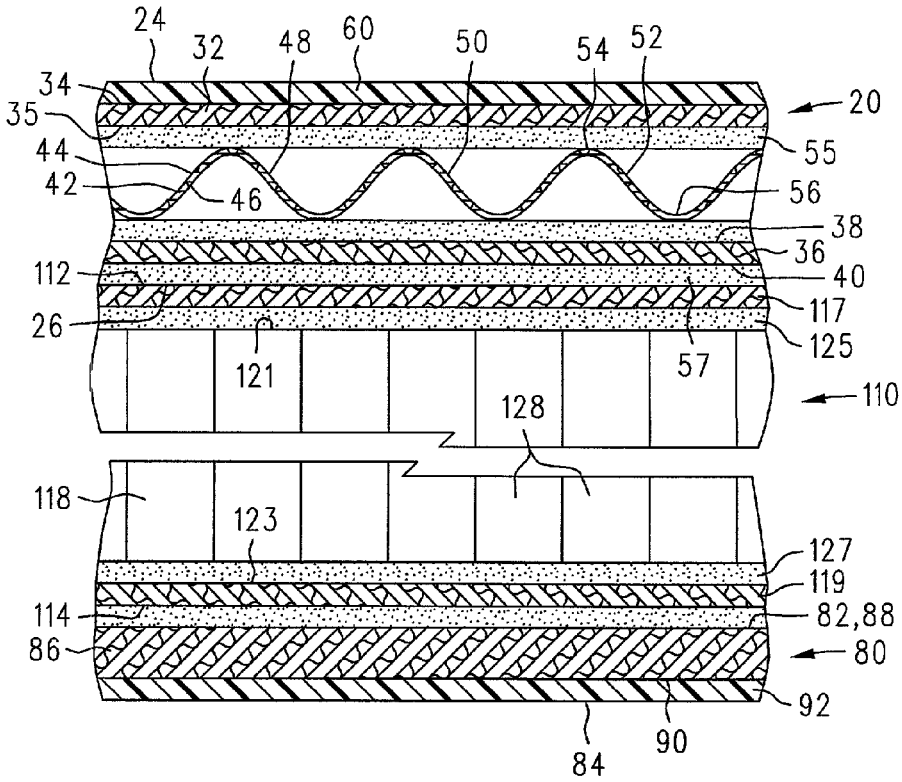
FIG. 3 is another more detailed cross sectional elevation view of a slip sheet pallet wherein the thickness of some of the layers has been exaggerated for illustrative purposes.
Figure 4:
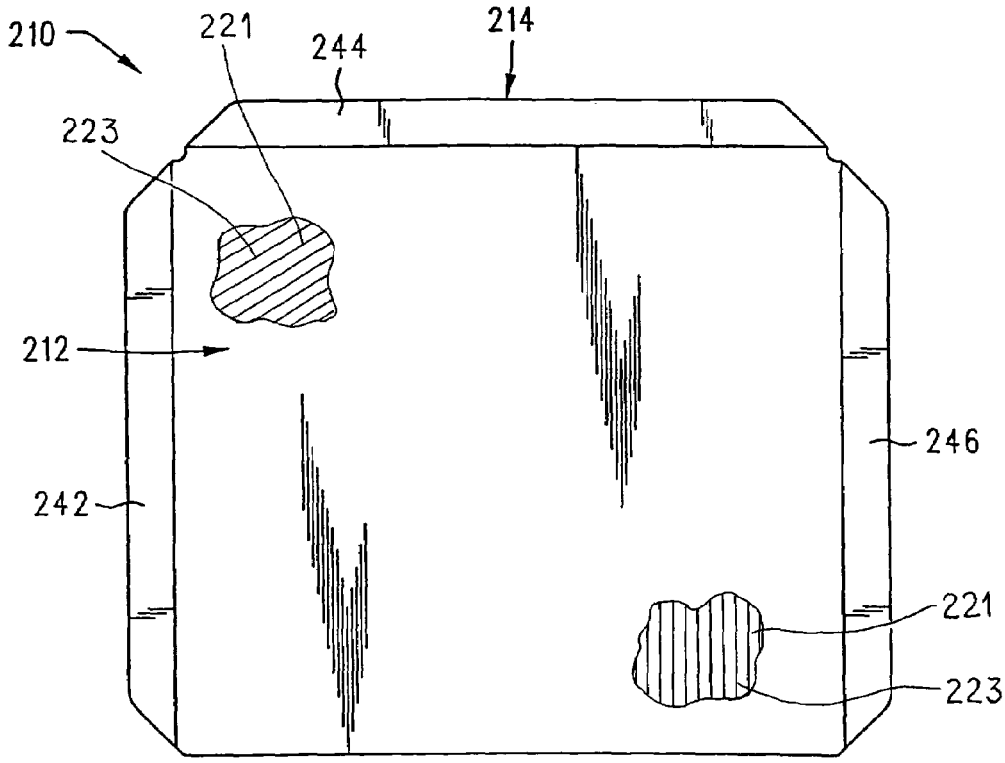
FIG. 4 is a top plan view of another embodiment of a slip sheet pallet.
Figure 5:
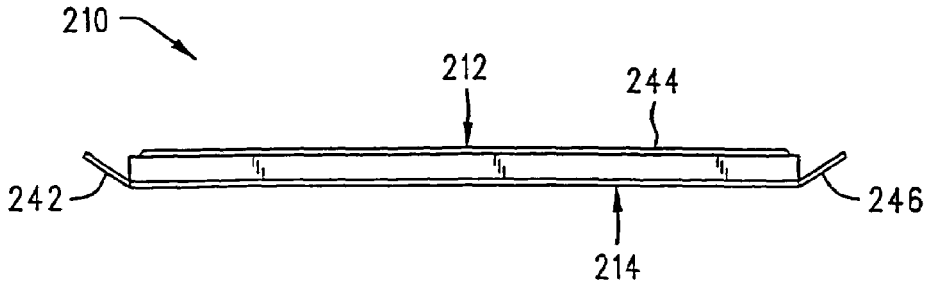
FIG. 5 is a front elevation view of the slip sheet pallet of FIG. 4.

Top sheet 20, as best illustrated in FIGS. 2 and 3, includes a top surface 24 and a bottom surface 26. The top sheet 20 terminates at lateral edge surfaces 21, 23, 25, 27, which may be planar vertical surfaces. Edge surfaces 21 and 25 are in one embodiment, parallel, and arranged perpendicular to parallel edge surfaces 23 and 27. In one embodiment the top sheet 20 is a double walled corrugated sheet including, as shown in FIG. 3, a top wall paper layer 32 a bottom wall paper layer 36 and an intermediately disposed serpentine (fluted) paper layer 42. The three paper layers 32, 36, 42 are preferably coextensive.

The top wall 32 has an upper surface 34 and a lower surface 35. The bottom wall 36 has an upper surface 38 and a lower surface 40. The intermediately disposed fluted member 42 has an upper surface 44 and a lower surface 46. The intermediate member comprises a plurality of longitudinally extending flutes 48, 50, 52 defined by a series of flute crests 54 and troughs 56. The upper surface 44 of crests 54 are adhered as by a water based glue layer 55 to the lower surface 35 of top wall 32. The lower surface 46 of the troughs 56 are adhered as by a glue layer 57 to the upper surface 38 of bottom wall 36.

A moisture barrier layer 60 may be applied to the top wall 32 to prevent moisture penetration into the top sheet 20. The moisture barrier may be a layer of spray coated material or alternatively may be a layer applied as a hot melt or may comprise a plastic film material which is adhered to the upper surface 34 of paper layer 32 by a suitable adhesive. As another alternative, the top wall 32 may be impregnated with a moisture barrier to prevent moisture penetration therethrough by known commercial processes such as rod or gravure application. Commercially available coating material includes repulpable moisture vapor barriers such as Vapor Coat and X300, both manufactured by Michelman, Inc., 9080 Shell Road, Cincinnati, Ohio 45236; or V-647 Pro Shield Release Coating manufactured by Progressive Coatings, 455, West 61$^{st}$ Street, Shreveport, La. 71106. A typical coating thickness is 3 wet lbs. Per 1,000 square feet of surface area.

Top sheet 20 preferably has a thickness of between 0.0468 inches and 0.1406 inches and more preferably between 0.0625 inches and 0.09375 inches.

Commercially available materials suitable for forming the top sheet 20 include industry standard single-walled, B-flute corrugated sheet such as single-walled or double walled container board sold by International Paper having a business address of 6400 Poplar Avenue, Memphis, Tenn. 38197.

Base sheet 80, as best illustrated by FIG. 3, comprises a top surface 82 and a bottom surface 84. Base sheet 80 may have a fiberboard layer 86 which may be formed from fiberboard having a thickness of preferably between 0.085 inches and 0.120 inches and most preferably between 0.090 inches and 0.10 inches. The fiberboard layer has a top surface 88 and a bottom surface 90. The bottom surface 90 is coated with a moisture barrier layer 92 which may be similar or identical to the moisture barrier layer 60 described above for the top sheet 20. Commercially available fiberboard suitable for use in base sheet 80 include fiberboard sold by Gaylord Container Corp. having a business address of 186 Bayline Circle, Folsome, Calif. 95630.

Intermediate sheet 110 comprises a top surface 112, a bottom surface 114, and four lateral side faces 111, 113, etc. (only two shown) arranged below and parallel to lateral edge surfaces 21, 23, 25, and 27, respectively, of top sheet 20. Intermediate sheet 110 may comprise a honeycomb layer 118 and top and bottom layers 117, 119. The top and bottom layers are adhered to top and bottom surfaces 121, 123 of honeycomb layer 118 by adhesive such as water base glue layers 125, 127. The honeycomb portion 118, as shown in FIG. 1, comprises a plurality of hexagonal cross sectioned cells 120, 122, 124, 126, etc. Each of the cells of the honeycomb has six vertically extending side walls 128. The cells may be 1 inch in height and may have a maximum cross section dimension of about ⅜ inch. (Many other widths ranging up to 3 or 4 inches may also be acceptable depending upon strength, elasticity, etc.) The honeycomb may be manufactured from 26 lb. kraft paper. The top and base layers 117, 119 may be 42 lb. kraft paper. A moisture barrier 130 is applied to the exposed sidewall of intermediate sheet 110 and may also be applied to the top sheet sidewalls 21, 23, 25, 27 as well. The moisture barrier 130 may comprise any suitable water resistant coating such as for example Michelman Vapor Coat manufactured by Michelman, Inc. having a business address of 9080 Shell Road, Cincinnati, Ohio 45236. Another suitable material is: V-647 Pro Shield Release Coating, manufactured by Progressive Coatings having a business address of 455 West 61$^{st}$ Street, Shreveport, La. 71106.

As best shown by FIG. 2 flaps 14, 16, 18 may be provided through extension of base sheet 80. The flaps ordinarily are tilted upwardly at an angle u of about 30 degrees as a result of a crease 132, 134, 136, provided along the length of each flap. Each flap may have a linear outer terminal portion 140, FIG. 1, position parallel to the adjacent lateral sides 111, 113, etc. of the intermediate layer. Each flap also comprises opposite linear, tapering edge portions 142, 144 which in one preferred embodiment are sloped at an angle v of about 45 degrees from edge 140.

In one preferred embodiment of the invention the slip sheet 10 is adapted to receive a total of 120 cases (24 beverage cans or bottles per case) stacked 10 tiers high, 12 cases per tier and having a total weight of approximately 2,800 pounds. In a warehouse the loaded slip sheets are often stacked four high and thus the bottom slip sheet must support 4×2,800 lbs.=11,200 lbs. Each case has a rectangular shape with a base measuring 15–¾ inches by 10–⅜ inches. In this preferred embodiment the dimensions of the slip sheet, with reference to FIG. 1, may be as follows: a=53.50 inches; b=46.00 inches; c=3.75 inches; d=43.50 inches; e=39.75 inches; f=3.75 inches; g=a radius of 1.0 inch for an outwardly facing concave surface; and h=1.125 inches maximum. (Other case configurations, such as 18 container cases may of course be supported on similar pallets with suitable modification to accommodate the different case size.) The co-efficient of friction on the top surface 24 is preferably between about 0.30 and about 0.50 and is most preferably between about 0.35 and about 0.45. The co-efficient of friction on the bottom surface 84 is preferably between about 0.30 and about 0.50 and is most preferably between about 0.35 and about 0.45.

Although one preferred construction for top sheet 20 has been described above in detail, various alternatives to that construction may also be employed including: multi-ply corrugated paperboard; single layer paperboard; multilayered, uncorrugated paperboard; plywood; particle-board;

chip board; cork; fiberglass; plastic; rubber; natural or synthetic fabric which may be woven or unwoven; metal plate; or composites of any of the above described materials or other materials. Similarly, the same type alternatives as discussed immediately above could be used for the bottom sheet 80.

An integral flap formed from the bottom layer 80 was described with reference to the preferred embodiment of FIGS. 1 and 2; however, various alternatives to that flap construction may also be used. For example, integral flaps could be provided by extending and laminating a portion of the top layer to an extension of the bottom layer. Another alternative would be to extend both top intermediate and bottom layers and then to crush/compress the intermediate layer between the top and bottom layers while fixing the top layer relative to the bottom layer as by rivet devices or the like. Other alternative composite flap configurations formed from top and bottom layers are described in U.S. Pat. Nos. 4,906,510 and 4,507,348 which are hereby incorporated by reference for all that is disclosed therein. As a further alternative the flaps may be provided in a non-integral configuration from material identical to or different from the material used in the body 12 of the slip sheet 10. Such flaps may be configured geometrically the same as those described above with reference to FIGS. 1 and 2 but may be attached to the body 12 by hinges which may be formed from the fabric or high strength paper or other high strength flexible material which is adhered to both the body 12 and each flap at various points along the length of the flap, either at the top surface of the flap or the bottom surface of the flap or at both top and bottom surfaces. In such a configuration the top hinge material may be used to hold the flap in an upwardly inclined position such as illustrated in FIG. 2 to maintain an angle u of approximately 30 degrees. The flaps may also be glued on flaps.

The intermediate sheet 110 provides most of the shock absorbing and deformation resisting capability of the slip sheet 10 through its use of compressible, relatively elastic honeycomb material. The honeycomb material is preferably a paper material, but could in the alternative be formed from a number of different materials including rubber, foam rubber, plastic, plastic foam, or any other suitable material. Also, various geometric structures other than a honeycomb structure might be employed, for example, a parallelepiped shaped plate of plastic foam, multilayered corrugated board, gel, foam rubber, cork, or any of the various materials used for other shock absorbing purposes such as those used in the construction of athletic shoes. Other shapes such as egg carton shapes, or multiple truncated cone shapes, truncated pyramid shapes, dome shapes, cylinder shapes, standing rib shapes, etc. could be used. Also, rather than providing shock absorbing material in a sheet or plate, a bladder structure might be used, for example, an air bladder constructed from plastic or other suitable material and having either multiple, independent chambers or a single air chamber. Another alternative would be to provide an enclosure sealed at the top and bottom by the top and bottom sheets 117, 119 and sealed around the periphery by a suitable layer of plastic sealant or the like. This enclosure could be filled with various types of elastic, granular materials such as plastic foam or foam rubber peanuts or pebbles. Similarly, crushed paper or other types of shock absorbing "loose" material might be placed in such a cavity.

While a multilayered slip sheet 10 having a compound top sheet 20, a compound bottom sheet 80, and a compound intermediate sheet 110 has been described above in the illustrated embodiment, it would also be possible to provide a slip sheet formed from one homogeneous material such as gel, cork, or plastic having a top layer and a bottom layer provided with appropriate moisture barrier material having a coefficient of friction in the ranges discussed above. The slip sheet 10 embodiment described above with reference to FIGS. 1–3 may be used to support 480 cases of beverage having a total weight of approximately 11,200 lbs., in a four slip sheet high, loaded stacking arrangement. This slip sheet is capable of significant shock absorption and yet weights only about 7–10 lbs. (as opposed to 40–90 lbs. For a typical wood pallet).

The above described slip sheet 10 embodiment substantially meets the following loading and deflection specifications:

a) Vertical load carrying requirements.

i) Uniform load. The slip sheet shall support a two stack high uniform load of 5,600 pounds while being carried by a pull pack modified fork lift truck. The load shall be distributed on the top face of the slip.

ii) Warehouse load. The slip sheet shall support a static load equivalent to four full beer pallets stacked vertically (11,200 pounds) upon a level concrete floor. Deflection of the honeycomb shall be less than or equal to ¼ inch. The deflection must be uniform across the slip sheet diagonal±⅛.

iii) Concentrated load. The slip sheet shall support a single static concentrated load of 300 pounds distributed over an area 6 inch×6 inch placed at the corner of the slip sheet. Deflection of the slip sheet shall not exceed ¼ inch in the loaded area.

iv) Racking load. The slip sheet shall be able to support 2800 pounds on a three rail rack with rails spaced at 22 inches. Rack rails shall be 2 inches wide and the full length of the slip sheet.

b) Impact load requirements.

i) Uniform load. The slip sheet must resist a uniformly distributed impact load while fully supported on a pull pack modified fork lift truck equivalent to 1.25 times the load described in (a)(i) above, in conformance with ASTM specification D1185. There shall be no permanent deformation or buckling of the honeycomb sheet.

ii) Horizontal load. The slip sheet shall resist a load created by driving the fork lift at 10 mph and applying the brakes without release while supporting the load defined in (a)(i) above. The platen is to be tilted at 10- toward the truck. The slip sheet and load shall remain upright upon the platen and shall not shift more than 2 inches in the direction of travel. There shall be no permanent deformation or buckling of the honeycomb sheet.

ii) Horizontal concentrated load. The slip sheet must be capable of distributing a lateral load of 300 pounds applied to the mid height of the top pallet during the stacking process. The bottom slip sheet shall incur no localized deformation and shall maintain the stacked beer pallets in a stable and vertical position.

iv) Railcar and truck vibration loads. The slip sheet shall be capable of supporting a double stacked load, i.e., two loaded pallets while being submitted to ASTM testing methods D4169, Random Test Option, Assurance level II.

The above slip sheet of FIGS. 1–3 achieves these loading and deflection requirements in a relatively compact, lightweight and inexpensive construction which is sufficiently durable to be used once from manufacturer to retail outlet, i.e., manufacturer warehouse handling, shipment to retail distributor and retail distributor warehouse handling. The slip sheet 10 may then be easily ground up and, depending upon the waterproof coatings used, recycled. Polypropylene for example, is readily recycled.

Another embodiment of a slip sheet pallet 210 is illustrated in FIGS. 4–9. Double slip sheet 210 comprises a single top sheet 212 and a single bottom sheet 214.

The top sheet 212 may be rectangular in shape with a top surface 220, a bottom surface 222 and four lateral side edge surfaces 224, 226, 228, and 230.

The bottom sheet 214 has a central body portion 240 which may be of the same general size and shape as the top sheet 212. The bottom sheet also comprises at least one and preferably 3 flaps 242, 244, 246 integrally formed with the central body portion. The bottom sheet has a top surface 250, a bottom surface 252 and side wall surfaces 254, 256, 258 located at the terminal edges of flaps 242, 244, 246, respectively. Another side wall edge surface 260 is located at the side of the bottom sheet 214 which does not include a flap.

The plan view dimensions of the slip sheet pallet 210 may be any dimensions which are commensurate with the size and shape of the object or objects to be loaded on the pallet. It may, for example, be the same or similar to that described above with reference to FIG. 1 for the loading arrangement described for that embodiment.

The bottom sheet 214 may be a homogeneous, dimpled, single plastic layer sheet such as is currently used commercially as a stand alone slip sheet. It may be the same as the slip sheet described in detail in U.S. Pat. No. 5,226,372 issued Jul. 13, 1993 of Frenkel, et al. for Slip Sheet with cushioning Effect which is hereby incorporated by reference for all that it discloses. The bottom sheet 214 preferably comprises a single layer of plastic which in one preferred embodiment has a thickness of about 0.05 to 0.06 inches with downwardly projecting dimples 213, 215, etc. evenly distributed across the central body portion 240 on about 1.0 inch centers. Each dimple may have a height of about 0.1 inch and a radius of about 0.25 inch.

The top sheet 212 in one embodiment comprises a single honeycomb layer of paper material covered by top and bottom layers of paper material which are adhered to the honeycomb layer in the same manner as described above with respect to honeycomb layer 118, top and bottom layers 117 and 119, and glue layers 125, 127. In one embodiment the cell size of the honeycomb layer is ½ inch, i.e. ½ inch between opposite side walls. The honeycomb may be constructed from craft paper such as 26 lb. to 32 lb. mullen verse paper having a cell wall thickness of 0.01 inches. The top and bottom layer paper may be the same as the cell wall paper or slightly thicker, e.g. 10% thicker then the cell wall paper. In one embodiment in which the cell height is ½ inch the stiffness per surface area of the top layer may be approximately 94,447 lbs./inch/sq. inch. In an embodiment in which the cell height is 1 inch the stiffness per surface area may be approximately 47,223 lbs./inch/sq. inch. In an embodiment in which the cell height is 2 inches the stiffness per surface area is approximately 23,611 lbs./inch/sq. inch.

In another embodiment in which the cell size is ⅜ inch, i.e ⅜ inch between side wall faces of the cell and in which the materials and paper thickness etc. remain the same as in the above example. The stiffness per surface area for ½ inch height is 89,465 lbs./inch/ sq. inch; for 1 inch cell height is 44,732 lbs./inch/ sq. inch and for 2 inch height is 22,366 lbs./inch. sq. inch.

Figure 6:
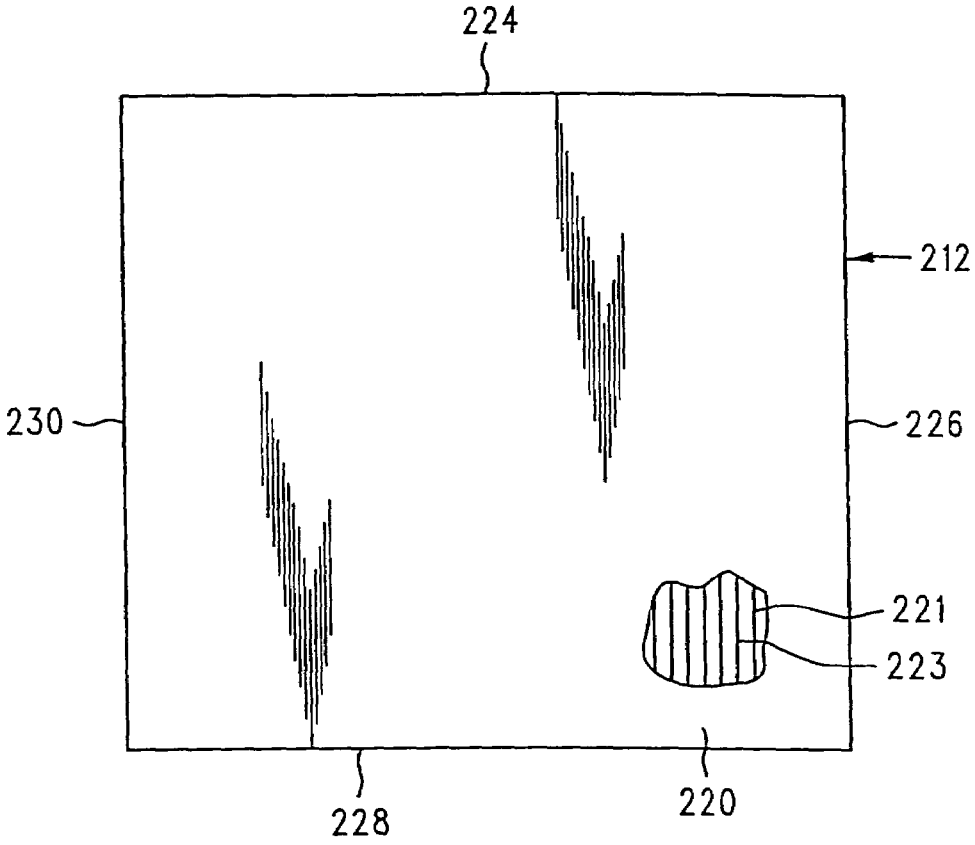
FIG. 6 is a top plan view of a top sheet portion of the slip sheet pallet of FIG. 4.
Figure 7:
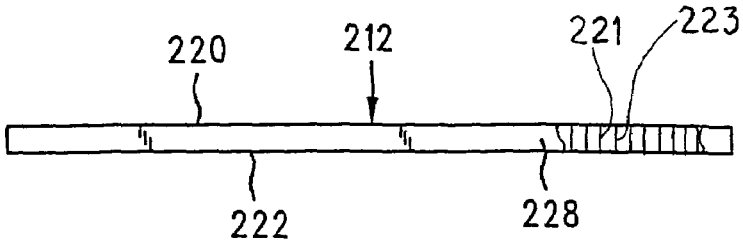
FIG. 7 is a front elevation view of the top sheet portion of the slip sheet pallet of FIG. 4.
Figure 8:
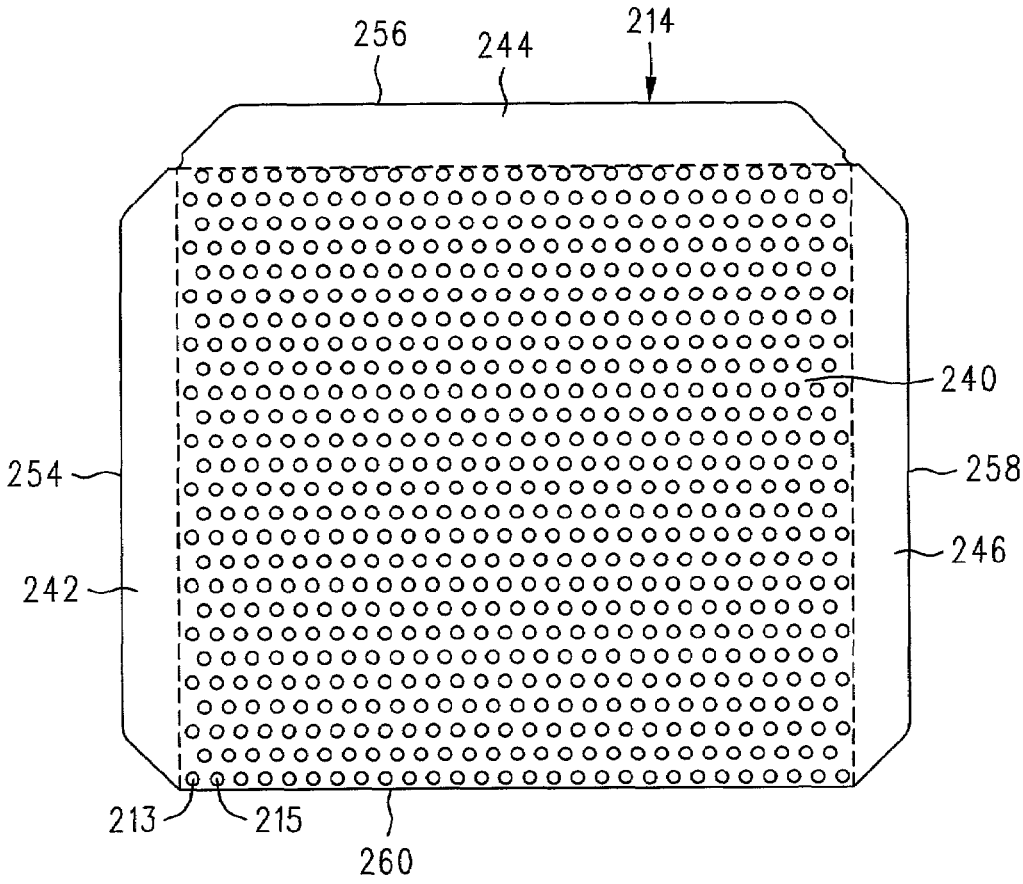
FIG. 8 is a top plan view of a bottom sheet portion of the slip sheet pallet of FIG. 4.
Figure 9:
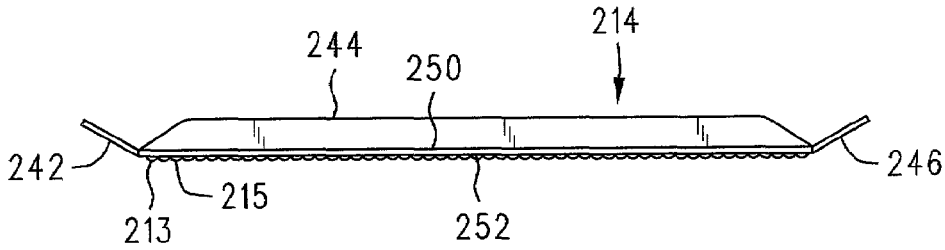
FIG. 9 is a front elevation view of the bottom sheet portion of the slip sheet pallet of FIG. 4.

In another embodiment of the top sheet 212 the top sheet comprises a standing rib polypropylene sheet having a construction similar to the double walled corrugated sheet illustrated in FIG. 3, including a top layer and a bottom layer. However the top and bottom layers are adhered to an intermediately disposed vertical (standing) rib layer (rather than a fluted layer). In one embodiment the top and bottom polypropylene sheets have a thickness of 0.03 inches and each rib 221,223 etc. in the ribbed layer has a thickness of 0.02 inches. The height of each rib 221, 223, etc., may be 0.37 inches and the spacing between ribs may be 0.41 inches. This embodiment may have a stiffness per surface area of approximately 117,592 lbs./inch/sq. inch. An identical design except having a rib height of 0.29 inches may have a stiffness per surface area of approximately 150,031 lbs./inch/sq. inch. The lateral direction that the ribs extend may be the same direction as shown for the fluting in FIG. 1, or may be in a direction perpendicular to the direction shown in FIG. 1, i.e. parallel to edges 226, 230 and 132, 136, as shown in FIG. 6, or may be in a direction diagonal to creases 132, 136. One advantage of a plastic sheet, whether ribbed or honeycomb or other construction, over a similar paper sheet is moisture resistance.

The double sheet slip sheet pallet 210 may have the top sheet 212 secured to the bottom sheet 214 by conventional adhesives, by sonic welding, stapling, riveting, or other attachment means. The top sheet 212 may also be secured to the bottom sheet 214 simply by friction. In this embodiment the top sheet 212 is simply laid on top of the bottom sheet 214 prior to loading the double slip sheet pallet 210. The friction between surfaces when the slip sheet pallet is in a loaded state is sufficient to prevent lateral shifting between the two sheets 212, 214. In such an embodiment the static coefficient of friction between the two sheets is preferably at least about 0.3 and is preferably about 0.4. One advantage of frictional or other easily disconnectable sheet attachment arrangement is that the more easily damaged top sheet 212 may be readily replaced after the slip sheet pallet 210 has been used, thus, saving the cost of replacing both sheet components of the compound slip sheet 210.

Cans located in the bottom case of a fully loaded pallet are subject to considerable shocks due to rail car and truck vibrations and to dynamic loads and defections associated with lift truck operation. The above described slip sheets of FIGS. 1–9 have been found to absorb sufficient shock and resist deformation sufficiently to significantly reduce bottom row damage to beverage cans.

It is contemplated that the inventive concepts herein described may be variously otherwise embodied and it is intended that the invention is construed to include all such alternative embodiments except insofar as limited by the prior art.

What is claimed is:

1. A slip sheet comprising:

a bottom sheet engagable with a lift truck platen, the bottom sheet having a central body portion and at least one flap connected to and extending outwardly from the bottom sheet, the flap adapted for gripping by a lift truck gripping assembly; and a top sheet positioned in a overlying relationship with the central portion of the bottom sheet and engagable with a stacked array which is to be supported on the slip sheet, the top sheet including a top layer, a bottom layer, and an intermediate shock-dampening layer, the shock dampening layer extending substantially continuous and coextensive with the central body portion to provide substantially coextensive shock-dampening support to the stacked array over the central body portion.

2. The slip sheet of claim 1, wherein the shock dampening layer comprises a honeycomb layer.

3. The slip sheet of claim 1, wherein the shock dampening layer comprises a standing rib layer.

4. The slip sheet of claim 1, wherein the shock dampening layer comprises a fluted layer.

5. The slip sheet of claim 4, wherein the flutes extend laterally parallel to the flap.

6. The slip sheet of claim 4, wherein the flutes extend perpendicularly to the flap.

7. The slip sheet of claim 4, wherein the flutes extend diagonally to the flap.

8. The slip sheet of claim 1, wherein the bottom sheet is comprised of plastic.

9. The slip sheet of claim 1, wherein the top sheet is comprised of plastic.

10. The slip sheet of claim 9, wherein the plastic is polypropylene.

11. The slip sheet of claim 1, wherein the top sheet and the bottom sheet are attached by sonic welding.

12. The slip sheet of claim 1, wherein the top sheet and the bottom sheet are attached by adhesive.

13. The slip sheet of claim 1, wherein the top sheet and the bottom sheet are attached by friction.

14. The slip sheet of claim 1, wherein the bottom sheet includes a plurality of downward projecting dimples distributed across the central body portion.

15. The slip sheet of claim 14, wherein the dimples have a projection height of about 0.1 inches.

16. The slip sheet of claim 1, wherein the central body portion is generally rectangular.

17. The slip sheet of claim 1, wherein the top sheet is about one-half inch thick or less.

18. The slip sheet of claim 1, wherein the material of the bottom sheet had a thickness of between about 0.05 inches and about 0.06 inches.

19. A slip sheet comprising:

a bottom sheet comprised of plastic and engagable with a lift truck platen, the bottom sheet having a central body portion and at least one flap connected to and extending outwardly from the bottom sheet, the flap adapted for gripping by a lift truck gripping assembly; and a top sheet positioned in a overlying relationship with the central portion of the bottom sheet and engagable with a stacked array which is to be supported on the slip sheet, the top sheet including a top layer, a bottom layer, and an intermediate shock-dampening layer, the shock dampening layer extending substantially coextensive with the central body portion to provide substantially coextensive shock-dampening support to the stacked array over the central body portion.

20. A slip sheet comprising:

a bottom sheet engagable with a lift truck platen, the bottom sheet having a central body portion and at least one flap connected to and extending outwardly from the bottom sheet, the flap adapted for gripping by a lift truck gripping assembly; and a top sheet comprised of plastic, the top sheet positioned in a overlying relationship with the central portion of the bottom sheet and engagable with a stacked array which is to be supported on the slip sheet, the top sheet including a top layer, a bottom layer, and an intermediate shock-dampening layer, the shock dampening layer extending substantially coextensive with the central body portion to provide substantially coextensive shock- dampening support to the stacked array over the central body portion.

* * * * *

UNITED STATES PATENT AND TRADEMARK OFFICE

CERTIFICATE OF CORRECTION

PATENT NO. : 7,013,814 B2
APPLICATION NO. : 09/797136
DATED : March 21, 2006
INVENTOR(S) : Modesitt et al.

It is certified that error appears in the above-identified patent and that said Letters Patent is hereby corrected as shown below:

(73) of the Title page;
"Illinois Tool Works Inc." is the correct name of the Assignee that should appear on the cover page of the above identified patent.

Signed and Sealed this

Eleventh Day of July, 2006

JON W. DUDAS
*Director of the United States Patent and Trademark Office*